US006254697B1

(12) United States Patent
Tashiro et al.

(10) Patent No.: US 6,254,697 B1
(45) Date of Patent: Jul. 3, 2001

(54) CAST STEEL MATERIAL FOR PRESSURE VESSELS AND METHOD OF MAKING A PRESSURE VESSEL BY USING SAME

(75) Inventors: Yasunori Tashiro; Masakatsu Ueno, both of Kitakyushu; Akitsugu Fujita, Nagasaki; Masatomo Kamada, Yokohama, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/526,811

(22) Filed: Mar. 16, 2000

(30) Foreign Application Priority Data

Mar. 19, 1999 (JP) ..... 11-075402

(51) Int. Cl.[7] ..... C21D 9/00

(52) U.S. Cl. ..... 148/335; 148/663; 420/106; 420/109

(58) Field of Search ..... 420/106, 109; 148/663, 660, 335

(56) References Cited

FOREIGN PATENT DOCUMENTS

| | | | |
|---|---|---|---|
| 0 835 946 A1 | 4/1998 | (EP) | C22C/38/54 |
| 06088167 | 3/1994 | (JP) | C22C/38/00 |
| 08225884 | 9/1996 | (JP) | C22C/38/00 |
| 08260091 | 10/1996 | (JP) | C22C/38/00 |
| 9137251 | 5/1997 | (JP) | C21D/9/00 |
| 11029837 | 2/1999 | (JP) | C22C/38/00 |

OTHER PUBLICATIONS

European Search Report, European Patent Application No. 00105431.1–2309–, Date Mailed: Jul. 7, 2000.

*Primary Examiner*—Deborah Yee
(74) *Attorney, Agent, or Firm*—Myers Bigel Sibley & Sajovec, P.A.

(57) ABSTRACT

The present invention provides a cast steel material for pressure vessels which has improved impact resistance (weldability) and toughness while maintaining its creep rupture strength at a level equal to or higher than the excellent creep rupture strength currently possessed by CrMoV cast steel, as well as a method of making a pressure vessel (or cast steel article) by using this cast steel material which permits a pressure vessel to be made without requiring a material working step such as forging. Specifically, the present invention relates to a cast steel material for pressure vessels which contains C, Si, Mn, Ni, Cr, Mo, V, W, Nb and/or Ta, B, Ti, Al, N, O, P and S in predetermined proportions, the balance being Fe and incidental impurities, provided that the contents of Ti, Al, O and N satisfies the following relationship:

$$N-0.29\{Ti-1.5((O-0.89Al)\}\leqq 0.0060\%,$$

and to a method of making a pressure vessel wherein the aforesaid cast steel material is cast and then heat-treated under predetermined conditions.

2 Claims, No Drawings

CAST STEEL MATERIAL FOR PRESSURE VESSELS AND METHOD OF MAKING A PRESSURE VESSEL BY USING SAME

BACKGROUND OF THE INVENTION

1. Field of the Invention

This invention relates to cast steel materials for the manufacture of casings and pressure vessels for use in steam turbine plants for thermal electric power generation, and a method of making a pressure vessel (or cast steel article) by using such a cast steel material.

2. Description of the Related Art

As casings and pressure vessels for use in steam turbine plants for thermal electric power generation, cast steel articles are frequently used in order to accommodate their complicated shapes. The properties required for such cast steel articles are such that they have excellent high-temperature strength and high creep rupture strength because they are used at high temperatures, and that they have excellent weldability because any defects in such cast steel materials need to be repaired by welding.

Generally known materials useful for this purpose include CrMoV cast steel, 2.25%CrMo cast steel and CrMo cast steel. Among them, 2.25%CrMo cast steel and CrMo cast steel have excellent impact resistance at ordinary temperatures and, as a result, good weldability. However, since they contain no strengthening element such as V, they have insufficient creep rupture strength and hence fail to meet the requirements of a material for the manufacture of casings of steam turbines having yearly rising operating temperatures.

On the other hand, the aforesaid CrMoV cast steel has high creep rupture strength and high mechanical strength owing to its high carbon content. However, it has poor impact resistance and, as a result., poor weldability. Accordingly, this material has the disadvantage that it cannot be easily repaired by welding in the process for the manufacture of casings and pressure vessels.

An object of the present invention is to provide a cast steel material for pressure vessels which has improved impact resistance (weldability) and toughness while maintaining its creep rupture strength at a level equal to or higher than the excellent creep rupture strength currently possessed by CrMoV cast steel, as well as a method of making a pressure vessel (or cast steel article) by using this cast steel material for pressure vessels which permits a pressure vessel to be made without requiring a material working step such as forging.

SUMMARY OF THE INVENTION

The present invention comprises the following embodiments.

[Embodiment 1]

A cast steel material for pressure vessels which contains, on a weight percentage basis, 0.04 to 0.1% C, 0.1 to 0.4% Si, greater than 0% and up to 0.2% Mn, 0.1 to 0.8% Ni, 3 to 4.5% Cr, 0.2 to less than 0.5% Mo, 0.2 to 0.4% V, 0.5 to 2% W, 0.01 to 0.06% Nb and/or Ta, 0.001 to 0.01% B, 0.005 to 0.045% Ti, 0.006 to 0.015% Al, greater than 0.005% and less than 0.01% N, 0 to 0.008% 0, 0 to 0.015% P as an impurity, and 0 to 0.007% S as an impurity, the balance being Fe and incidental impurities, provided that the aforesaid contents of Ti, Al, O and N satisfies the following relationship:

$$N-0.29\{Ti-1.5(O-0.89Al)\}\leqq 0.0060\%$$

[Embodiment 2]

A method of making a pressure vessel which comprises the steps of casting a cast steel material for pressure vessels in accordance with the above-described embodiment 1 to form a cast steel article in the form of a pressure vessel; normalizing the cast steel article by holding it at a temperature of 1,000 to 1,150° C. for 10 to 30 hours and cooling it to 200° C. or below; quenching the cast steel article by holding it at a temperature of 970 to 1,070° C. for 5 to 30 hours, cooling it at a cooling rate of 1 to 50° C. per minute until the temperature of various parts of the material reaches 600° C., and further cooling it to 200° C. or below; and tempering the cast steel article by holding it at a temperature of 680 to 740° C. for 5 to 20 hours.

The cast steel material for pressure vessels in accordance with the present invention is characterized in that the excellent high-temperature strength (in particular, creep rupture strength) possessed by a conventional cast steel material is further enhanced and, moreover, good ductility and toughness are exhibited. The outstanding feature thereof is that it has markedly improved weldability and can hence be more easily formed into pressure vessels than conventional cast steel materials.

Consequently, by using the cast steel material for pressure vessels in accordance with the present invention, it becomes possible to reduce the wall thickness of the product and decrease the number of welding steps, and thereby manufacture pressure vessels at a lower cost than in the case of conventional materials. Moreover, this cast steel material not only has excellent properties, but also can reduce the material cost by minimizing the addition of expensive alloying elements, thus producing remarkable effects from an industrial point of view.

Furthermore, the method of making a pressure vessel by using the cast steel material of the present invention can provide pressure vessels having a well-balanced combination of ductility, toughness and creep rupture strength.

DETAILED DESCRIPTION OF PREFERRED EMBODIMENTS

The cast steel material for pressure vessels in accordance with the present invention and the method of making a pressure vessel by using the same will be more specifically described hereinbelow.

The reasons for content restrictions on various components contained in the cast steel material for pressure vessels (hereinafter referred to briefly as "cast steel materials) in accordance with the present invention are described below. In the following description, all percentages used to express contents are by weight unless otherwise stated.

C (carbon): C not only enhances the hardenability of the cast steel material, but also forms the carbides of Cr, Mo, Nb and V and thereby contributes to an improvement in creep rupture strength. If the content of C is less than 0.04%, no sufficient yield strength or creep rupture strength will be obtained. On the other hand, it is desirable that the content of C be as low as possible in order to secure weldability. That is, the content of C must be not greater than 0.1%. If the content of C is unduly high, it will be difficult to secure toughness. Moreover, carbonitrides will aggregate and coarsen during use to cause a reduction in strength upon long-term exposure to high temperatures. Accordingly, the content of C should be in the range of 0.04 to 0.1%. The preferred range is from 0.06 to 0.09%.

Si (silicon): Si is an element which is effective as a deoxidizer. Since castings are complicated in shape, the melt must be smoothly filled to all the corners of the mold. If not so, casting defects such as misrun and cold shut will occur and hence bring about a need for repair. Consequently, it is important to secure melt flowability, and Si is an element which is necessary for the securement of melt flowability. However, Si promotes segregation and thereby causes a reduction in the toughness of cast steel articles and also in the high-temperature strength thereof. If the content of Si is less than 0.1%, Si will not perform a proper function in acting as a deoxidizer and securing melt flowability. On the other hand, if Si is added in an amount of greater than 0.4%, the toughness and high-temperature strength of cast steel articles will be reduced. Accordingly, the content of Si should be in the range of 0.1 to 0.4%. The preferred range is from 0.2 to 0.35%.

Mn (manganese): Mn is an element which is useful in enhancing the hardenability of cast steel articles and is also effective in improving strength and toughness. However, the addition of an increased amount of Mn will tend to cause a reduction in the creep rupture strength of cast steel articles. Accordingly, the content of Mn should be greater than 0% (i.e., exclusive of 0%) and up to 0.2%. The preferred range is from 0.05 to 0.15%.

Ni (nickel): Ni enhances the hardenability of cast steel articles and is also effective in improving toughness. However, the addition of an unduly large amount of Ni will cause a reduction in the high-temperature strength, particularly creep rupture strength, of cast steel articles. If the amount of Ni added is less than 0.1%, no effect will be produced, while if it is greater than 0.8%, the creep rupture strength of cast steel articles will be reduced. Accordingly, the content of Ni should be in the range of 0.1 to 0.8%. The preferred range is from 0.2 to 0.5%.

Cr (chromium): Cr not only improves the oxidation resistance of the material, but also forms a carbide and thereby contributes greatly to an improvement in creep rupture strength. Although the optimum amount of Cr added is a little greater than 1% from the viewpoint of influence on the creep rupture strength of cast steel articles, the addition of a larger amount of Cr is desirable from the viewpoint of the securement of room-temperature strength by enhanced hardenability and the improvement of impact resistance. In the case steel material of the present invention, the amounts of other elements functioning to enhance hardenability, such as C, Mn and Mo, are minimized in order to maintain the toughness, weldability and creep rupture strength of the cast steel material at a high level. Consequently, the amount of Cr added must be increased in order to secure hardenability. If the amount of Cr added is less than 3%, no sufficient mechanical strength or toughness will be secured. On the other hand, if it is greater than 4.5%, the creep rupture strength of cast steel articles will be reduced. Accordingly, the content of Cr should be in the range of 3 to 4.5%. The preferred range is from 3.2 to 4.0%.

Mo (molybdenum): Mo forms a carbide and is hence effective in improving creep rupture strength. Moreover, Mo is also effective in improving hardenability and toughness. Especially in the material of the present invention, Mo, together with W, is an element which contributes to an improvement in high-temperature strength. The balance between the amounts of Mo and W added is important. In the cast steel material of the present invention, if the amount of Mo added is less than 0.2%, no sufficient effect will be produced, depending on the amount of W added as will be described later. On the other hand, if Mo is added in an amount of not less than 0.5%, the material will be embrittled during use. Accordingly, the content of Mo should be in the range of 0.2 to less than 0.5%. The preferred range is from 0.3 to 0.4%.

V (vanadium): V forms a fine carbide and thereby contributes greatly to an improvement in creep rupture strength. In the cast steel material of the present invention, if the amount of V added is less than 0.2%, no sufficient effect will be produced. On the other hand, if it is greater than 0.4%, a reduction in toughness will be caused. Accordingly, the content of V should be in the range of 0.2 to 0.4%. The preferred range is from 0.2 to 0.3%.

W (tungsten): W is one of the most important elements in the cast steel material of the present invention, and also constitutes a characteristic element thereof. W dissolves in the Fe-based matrix and thereby contributes to solid solution strengthening. Moreover, W functions to suppress the aggregation and coarsening of carbides formed by other alloying elements such as Cr, and thereby contributes greatly to an improvement in high-temperature strength. If the amount of W added is less than 0.5%, W will fail to improve high-temperature strength sufficiently. On the other hand, if it is greater than 2%, a reduction in room-temperature ductility and toughness will be caused to detract from weldability. Accordingly, the content of W should be in the range of 0.5 to 2%. The preferred range is from 0.8 to 1.6%.

Nb (niobium) and/or Ta (tantalum): Nb and Ta form carbides and thereby contribute to an improvement in the high-temperature strength of cast steel articles. However, these carbides need to be precipitated in the form of fine grains. If Nb and/or Ta are added in unduly large amounts, proeutectoid coarse carbides will be formed. They do not contribute to an improvement in high-temperature strength, but rather cause a marked reduction in ductility and toughness. If the amount of Nb and/or Ta added is less than 0.01%, they will fail to improve high-temperature strength sufficiently. On the other hand, if it is greater than 0.06%, proeutectoid coarse carbides will be formed. Accordingly, the content of Nb and/or Ta should be in the range of 0.01 to 0.06%. The preferred range is from 0.02 to 0.05%.

B (boron): B is an element which is important for the securement of strength and toughness. B dissolves in the matrix and grain boundaries and thereby produces the effect of enhancing the hardenability of cast steel articles and improving the strength and toughness thereof. If the amount of B added is less than 0.001%, B present in solid solution will be decreased to cause a reduction in hardenability, and proeutectoid ferrite will be precipitated to cause a reduction in strength and toughness. If the amount of B added is greater than 0.01%, the material will be embrittled. Accordingly, the content of B should be in the range of 0.001 to 0.01%. The preferred range is from 0.001 to 0.005%.

Ti (titanium): Ti is an element which forms a nitride and is important in securing the hardening effect of B. If the content of N is high, a large amount of BN will be precipitated at grain boundaries. This decreases the amount of B present in solid solution and thereby lessens the hardening effect of B, so that the precipitation of ferrite is promoted to cause a reduction in strength and toughness. Consequently, as a means for securing a hardening effect by the addition of a small amount of B, Ti is added so as to form a nitride (TiN). This can prevent B from forming a nitride (BN), and thereby serves to secure hardenability due to the presence of B in solid solution. If the amount of Ti added is less than 0.005%, the above-described effect will not be produced. On the other hand, if it is greater than 0.045%, a reduction in toughness will be caused. Accordingly, the content of Ti should be in the range of 0.005 to 0.045%. The preferred range is from 0.01 to 0.03%.

Al (aluminum): Like Ti, Al fixes N (in the form of AlN) and thereby functions to increase the amount of B present in solid solution and maximize the effect of B. If the amount of Al added is less than 0.006%, this effect will not be produced. On the other hand, if it is greater than 0.015%, a reduction in toughness will be caused. Accordingly, the content of Al should be in the range of 0.006 to 0.015%. The preferred range is from 0.008 to 0.012%.

N (nitrogen): N is a detrimental element in the cast steel material of the present invention. In order to maximize the hardening effect of B, the content of N should be as low as possible. Specifically, if the content of N is high, a large amount of BN will be precipitated at grain boundaries. This decreases the amount of B present in solid solution and thereby lessens the hardening effect of B, so that the precipitation of proeutectoid ferrite is promoted to cause a reduction in the strength and toughness of cast steel articles. Consequently, the hardening effect of B is secured by altering the content of B in proportion to the content of N. However, if the content of N is 0.01% or greater, a large amount of B will be required to cause an increase in the amount of the resulting precipitate (BN) and hence an embrittlement of the material. Although it is desirable that the content of N be as low as possible, a considerable steel making cost will be required to reduce the content of N to 0.005% or less. Accordingly, the content of N should be greater than 0.005% and less than 0.01%.

In the present invention, Ti and Al are added as elements for fixing N which interferes with the effect of B addition. In order to allow Ti and Al to function efficiently as nitride-forming elements, these Ti and Al must not be consumed by O (oxygen). In the present invention, therefore, the content of O (oxygen) is strictly limited with consideration for its relationship with the contents of N and the aforesaid nitride-forming elements. The present inventors have now found that, in order to minimize the precipitate of B (i.e., BN) and produce a powerful hardening effect by the addition of a small amount of B, the amount of N present in solid solution must satisfy the following relationship:

$$N-0.29\{(Ti-1.5(O-0.89Al)\}\leqq 0.0060\%$$

Thus, the hardening effect of B is sufficiently exhibited to form a bainite structure, and satisfactory strength, toughness and creep properties can be secured.

As described above, O (oxygen) readily forms the oxides of Al and Ti (in particular, the oxide of Ti). Thus, O consumes Ti and thereby prevents Ti from functioning as an element for fixing N. Consequently, it is desirable that the content of O be as low as possible. Moreover, since O forms oxide type inclusions and thereby reduces material characteristics, the content of O must be minimized from this point of view. To the present inventors' knowledge, it is desirable that the content of O be not greater than 0.008% (inclusive of 0%). The preferred range is up to 0.004%.

P (phosphorus): P is an impurity element. The content of P must be reduced by removing P sufficiently at the melting stage. In particular, P causes temper brittleness and thereby reduces the toughness of the material during use. Accordingly, the content of P should be not greater than 0.015% (inclusive of 0%). The preferred range is up to 0.01%.

S (sulfur): Like P, S is an impurity element. The content of S must be minimized because S tends to undergo segregation during the solidification of molten steel and produce microscopic defects (or microporosity). Accordingly, the content of S should be not greater than 0.007% (inclusive of 0%). The preferred range is up to 0.004%.

Next, the method of making a pressure vessel by using the above-described cast steel material is described below. The product obtained by the method of the present invention is a pressure vessel which is intended to be used in a high-temperature environment and which requires excellent high-temperature strength and, in particular, high creep rupture strength. Moreover, since this pressure vessel is a cast steel article and may unavoidably be subjected to repair by welding, it must have excellent weldability. For this reason, the pressure vessel needs to have good toughness. From this point of view, it is very important that the method of the present invention includes heat treatments under such conditions as to develop the aforesaid properties.

(1) Normalizing Treatment (i) Normalizing temperature: Prior to quenching, the cast steel article is subjected to normalizing treatment as a pretreatment. The purpose of this normalizing treatment is to minimize a phenomenon which causes alloying elements to be nonuniformly distributed in the cast material (i.e., the so-called segregation) and thereby obtain a homogeneous material. Accordingly, the cast steel article is held in as high a temperature range as possible to being about the effect of promoting the diffusion of atoms in the matrix and thereby reducing the segregation which occurred during solidification.

Moreover, Nb and/or Ta are contained in the cast steel material of the present invention. These elements form carbides and thereby improve high-temperature strength. In this case, the carbides need to be fine-grained. In the as-cast material, proeutectoid coarse carbides are formed as a result of the above-described segregation. These carbides as such do not entirely contribute to an improvement in high-temperature strength, but rather cause a reduction in ductility and toughness. Consequently, it is necessary to obtain fine carbides by dissolving Nb and/or Ta once in the matrix and precipitating them again. This purpose is accomplished in the normalizing treatment step.

Moreover, B is contained in the cast steel material of the present invention. When the precipitate of B (in the form of BN) which was formed during solidification is held in as high a temperature range as possible, B is dissolved in the matrix and produces the effect of enhancing hardenability. In order to accomplish the same purpose in the quenching step, it is necessary to raise the quenching temperature. However, such a rise in quenching temperature will coarsen crystal grains and thereby reduce ductility and toughness.

If the normalizing temperature is lower than 1,000° C., no sufficient diffusion of atoms will be caused. Moreover, the amount of Nb and/or Ta dissolved in the matrix is unduly small, and the amount of B dissolved in the matrix is also unduly small. On the other hand, the effect of the normalizing treatment will become saturated at a normalizing temperature of 1,150° C. Accordingly, the normalizing temperature should be in the range of 1,000 to 1,150° C.

After this normalizing treatment, the cast steel article is cooled to a temperature range of 200° C. and below, which completes the transformation from the high-temperature phase (austenite) to the room-temperature phase (bainite). Consequently, coarse crystal grains formed during the normalizing treatment will disappear in the following quenching treatment step, so that an appropriate grain size can be obtained during the quenching treatment.

(ii) Normalizing time: The normalizing time is important in that it affects the diffusion of alloying elements. It is also important in causing at least one of Nb and Ta, and B to be satisfactorily dissolved. If the normalizing time is less than 10 hours, no sufficient diffusion or dissolution will be achieved. On the other hand, the effect of the normalizing treatment will become saturated in 30 hours. Accordingly, the normalizing time should be in the range of 10 to 30 hours.

(2) Quenching Treatment (i) Heating temperature in quenching: The heating temperature in quenching (or solution temperature) greatly affects the grain size of the material. If the heating temperature in quenching is unduly high, the crystal grains will be coarsened to cause a reduction in the ductility and toughness of the material. On the other hand, if the heating temperature in quenching is unduly low, a reduction in creep rupture strength, strength and toughness will be caused owing to the precipitation of proeutectoid ferrite. For this reason, proper temperature control is required.

In the case of the cast steel material of the present invention, if the quenching treatment (or solution treatment) is carried out at a temperature higher than 1,070° C., the crystal grains will become so coarse that no sufficient ductility or toughness will be obtained. On the other hand, if the temperature for the quenching treatment (or solution treatment) is lower than 970° C., the quenching effect will be lessened to such an extent that no satisfactory material characteristics will be obtained. Accordingly, the heating temperature in quenching (or solution temperature) should be in the range of 970 to 1,070° C.

(ii) Holding time at heating temperature in quenching: The holding time at the heating temperature in quenching is such that the above-described quenching effect is achieved to the fullest extent. If the holding time is less than 5 hours, alloying elements cannot dissolve in the matrix of Fe (iron). Moreover, this will cause a problem in that the segregation or local concentration of alloying elements is not eliminated sufficiently. On the other hand, the effect of the solution treatment will become saturated in 30 hours. If the holding time exceeds 30 hours, the crystal grains will be coarsened on the contrary to cause a reduction in the ductility and toughness of the material. Accordingly, the holding time at the heating temperature in quenching should be in the range of 5 to 30 hours.

(iii) Cooling rate in quenching: The cooling rate in quenching strongly affects the strength and toughness of the material. If the cooling rate in quenching is low, no satisfactory creep rupture strength, strength or toughness will be achieved owing to the precipitation of proeutectoid ferrite. Accordingly, it is necessary to increase the cooling rate in quenching.

In practice, when a large-sized cast steel article is quenched, it is conceivable to increase the cooling rate by immersing it in oil or water. However, if the cast steel article has a complicated shape, this may cause problems such as deformation and cracking. In the present invention, therefore, the upper limit of the cooling rate should be 50° C. per minute and the lower limit thereof should be 1° C. per minute, until the temperature of various parts of the cast steel article is lowered from the quenching starting temperature to 600° C. It is an outstanding feature of the cast steel material of the present invention that its hardenability can be secured even at a cooling rate of 1° C. per minute to achieve high mechanical strength consistently.

(3) Tempering Treatment (i) Tempering temperature and time: The purpose of the tempering treatment is to eliminate any defects introduced during quenching and thereby yield a material having good toughness. The mechanical strength, ductility and toughness of the material vary according to this heat-treating temperature and holding time.

As the tempering temperature becomes higher and the holding time becomes longer, the tempering treatment proceeds further. This causes a reduction in the strength of the material, but an improvement in ductility and toughness.

On the other hand, as the tempering temperature becomes lower and the holding time becomes shorter, the material shows an improvement in strength, but a reduction in ductility and toughness. Consequently, the tempering temperature and time must be strictly controlled.

If the tempering treatment is carried out in a temperature range higher than 740° C., the resulting material will have good ductility and toughness, but will show a reduction in mechanical strength. If the tempering treatment is carried out in a temperature range lower than 680° C., satisfactorily high mechanical strength will be obtained, but a reduction in ductility and toughness will be caused. Accordingly, the temperature of the tempering treatment should be in the range of 680 to 740° C.

If the time of the tempering treatment is less than 5 hours, no sufficient dissolution or diffusion will be achieved, and no sufficient amount of fine carbonitrides will be precipitated. Consequently, no satisfactory creep rupture strength, ductility or toughness will be obtained.

On the other hand, the effect of the tempering treatment will become saturated in 20 hours. In addition, if the tempering treatment is carried out for more than 20 hours, the mechanical strength of the material will be reduced. Accordingly, the time of the tempering treatment should be in the range of 5 to 20 hours.

EXAMPLES

The present invention is more specifically explained with reference to the following examples.

The chemical compositions of materials used for testing purposes are shown in Table 1. All materials were prepared by melting the components in a 50 kg vacuum melting furnace and pouring the resulting melt into a mold formed of molding sand. The cast steel articles so formed were used as test pieces.

In Table 1, the values marked with an asterisk are outside the compositional range of the present invention.

The test materials (or cast steel articles) thus obtained by casting were subjected to heat treatments satisfying the heat-treating conditions specified by the method of the present invention as shown in Table 2. Thereafter, in order to examine the influence of variations in composition, the heat-treated test materials were subjected to a tension test, an impact test and a creep rupture test.

As is evident from Table 2, the cast steel materials of the present invention (i.e., the inventive materials) have a well-balanced combination of strength, ductility (e.g., elongation and reduction in area) and impact resistance, and exhibit consistently high property values. As used herein, the term "50%FATT" is an abbreviation for fracture appearance transition temperature. Smaller values of 50%FATT indicate better impact resistance. Moreover, a material having good impact resistance generally has good weldability.

In contrast, the comparative materials have an ill-balanced combination of strength, ductility and toughness. In particular, their impact resistance is comparatively poorer. In the testing conditions employed for creep rupture tests, the temperature and the stress were kept constant. Consequently, it may be said that materials exhibiting a longer rupture time has higher creep rupture strength. Thus, it can be seen that the cast steel materials of the present invention are also superior in creep rupture strength to the comparative materials.

Next, several cast steel materials of the present invention were tested in order to examine the influence on various properties of the heat-treating conditions specified by the method of the present invention. The results thus obtained are shown in Table 3.

It can be seen from Table 3 that, when subjected to heat treatments satisfying the heat-treating conditions specified by the method of the present invention, the resulting products have a well-balanced combination of strength, ductility (e.g., elongation and reduction in area) and impact resistance, and exhibit consistently high property values. In contrast, when subjected to heat treatments not satisfying the heat-treating conditions specified by the method of the present invention, the resulting products have an ill-balanced combination of properties.

When the heating temperature in quenching is lower than its specified range or the cooling rate in quenching is slower than its specified range, as compared with the heat-treating conditions specified by the method of the present invention, the precipitation of proeutectoid ferrite tends to occur and the resulting pressure vessels (or cast steel articles) show a reduction in strength, toughness and creep rupture strength.

When the heating temperature in quenching is higher than its specified range, the grain size becomes so large that the resulting products show a reduction in ductility and toughness.

When the tempering temperature is higher than its specified range, the resulting products have good ductility and toughness, but show low strength. On the other hand, when the tempering temperature is lower than its specified range, the resulting products have high strength, but show poor ductility and toughness.

TABLE 1

| | No. | C | Si | Mn | Ni | P | S | Cr | Mo | V | W | Nb + Ta |
|---|---|---|---|---|---|---|---|---|---|---|---|---|
| Invention material | 1 | 0.07 | 0.21 | 0.19 | 0.36 | 0.008 | 0.003 | 3.3 | 0.49 | 0.23 | 1.77 | 0.032 |
| | 2 | 0.09 | 0.17 | 0.18 | 0.40 | 0.007 | 0.002 | 3.7 | 0.25 | 0.22 | 1.80 | 0.035 |
| | 3 | 0.07 | 0.30 | 0.18 | 0.52 | 0.006 | 0.001 | 3.4 | 0.48 | 0.25 | 1.23 | 0.043 |
| | 4 | 0.06 | 0.25 | 0.19 | 0.35 | 0.005 | 0.004 | 3.2 | 0.47 | 0.30 | 1.45 | 0.025 |
| | 5 | 0.08 | 0.15 | 0.17 | 0.33 | 0.007 | 0.003 | 3.5 | 0.35 | 0.27 | 1.15 | 0.037 |
| | 6 | 0.05 | 0.20 | 0.14 | 0.56 | 0.010 | 0.003 | 3.4 | 0.41 | 0.24 | 1.62 | 0.028 |
| | 7 | 0.07 | 0.18 | 0.18 | 0.47 | 0.006 | 0.004 | 3.6 | 0.30 | 0.32 | 1.35 | 0.030 |
| Comparison material | 8 | 0.09 | 0.24 | 0.18 | 0.25 | 0.009 | 0.003 | 3.2 | 0.30 | 0.25 | 1.40 | 0.025 |
| | 9 | 0.09 | 0.24 | 0.10 | 0.43 | 0.009 | 0.003 | 3.2 | 0.32 | 0.25 | 1.40 | 0.025 |
| | 10 | *0.17 | 0.23 | 0.16 | *1.23 | 0.006 | 0.003 | *4.9 | 0.21 | 0.28 | 1.80 | *0.071 |
| | 11 | 0.09 | 0.23 | 0.19 | 0.55 | 0.009 | 0.003 | 3.4 | *0.10 | 0.25 | *2.52 | 0.025 |
| | 12 | 0.06 | 0.35 | 0.06 | 0.37 | 0.008 | 0.002 | *1.5 | 0.49 | 0.27 | 1.82 | 0.025 |
| | 13 | 0.06 | *0.54 | 0.15 | 0.41 | *0.018 | *0.010 | 3.2 | *0.80 | 0.31 | 1.56 | 0.042 |
| | 14 | 0.09 | 0.15 | 0.12 | 0.37 | *0.017 | *0.009 | 3.3 | 0.39 | *0.05 | 1.60 | *0.003 |
| | 15 | 0.05 | 0.25 | *1.52 | 0.29 | 0.009 | 0.001 | 4.0 | *1.20 | *0.6 | 0.80 | 0.030 |
| | 16 | *0.02 | 0.33 | 0.20 | 0.30 | 0.008 | 0.002 | *2.0 | 0.37 | 0.26 | *0.30 | 0.027 |

| | No. | Al | Ti | B | N | O | Value of equation 1 |
|---|---|---|---|---|---|---|---|
| Invention material | 1 | 0.007 | 0.007 | 0.0023 | 0.0054 | 0.0059 | 0.0032 |
| | 2 | 0.010 | 0.035 | 0.0035 | 0.0095 | 0.0080 | −0.0010 |
| | 3 | 0.006 | 0.025 | 0.0023 | 0.0080 | 0.0048 | 0.0005 |
| | 4 | 0.008 | 0.022 | 0.0019 | 0.0065 | 0.0077 | 0.0004 |
| | 5 | 0.007 | 0.028 | 0.0023 | 0.0090 | 0.0053 | 0.0005 |
| | 6 | 0.006 | 0.020 | 0.0021 | 0.0075 | 0.0068 | 0.0023 |
| | 7 | 0.009 | 0.018 | 0.0017 | 0.0061 | 0.0055 | −0.0002 |
| Comparison material | 8 | 0.005 | 0.015 | 0.0028 | 0.0900 | 0.0067 | *0.0866 |
| | 9 | 0.007 | 0.010 | 0.0030 | 0.0095 | 0.0073 | *0.0071 |
| | 10 | 0.008 | *0.003 | 0.0032 | 0.0055 | 0.0079 | 0.0050 |
| | 11 | *0.001 | 0.016 | 0.0015 | 0.0090 | *0.0089 | *0.0078 |
| | 12 | 0.007 | *0.003 | *0.0003 | 0.0098 | 0.0065 | *0.0090 |
| | 13 | *0.023 | 0.024 | 0.0021 | 0.0096 | *0.0102 | −0.0018 |
| | 14 | 0.009 | 0.033 | 0.0033 | 0.0065 | *0.0098 | −0.0023 |
| | 15 | 0.007 | 0.070 | *0.0130 | *0.0142 | 0.0065 | −0.0060 |
| | 16 | 0.010 | 0.015 | 0.0005 | *0.0112 | 0.0054 | 0.0053 |

*It shows components outside a scope of claim.
Each numeral value indicates wt %.
$N - 0.29\ (Ti - 1.5\ (O - 0.89Al))$ . . . equation 1

TABLE 2

| Test material | | Heat treatment conditions: Normalizing temperature (° C.) × Holding time (H) | Quenching temperature (° C.) × Holding time (H) | Tempering temperature (° C.) × Holding time (H) | Quenching speed (° C.) × Holding time (H) | Tensile test at room temperature: 0.2% proof stress (kgf/mm²) | Tensile strength (kgf/mm²) | Elongation (%) | Reduction of area (%) | Impact test 50% FATT (° C.) | Creep rapture test: Test temperature: 600° C. Rupture stress: 15 kgf/mm² Rupture time (H) |
|---|---|---|---|---|---|---|---|---|---|---|---|
| Invention material | 1 | 1100° C. × 20 H | 1050° C. × 12 H | 720° C. × 12 H | 250 | 45.4 | 56.4 | 29.8 | 78.2 | 10 | 2,562 |
| | 2 | 1100° C. × 20 H | 1050° C. × 12 H | 720° C. × 12 H | 250 | 43.2 | 58.8 | 26.6 | 76.7 | -2 | 2,657 |
| | 3 | 1100° C. × 20 H | 1050° C. × 12 H | 720° C. × 12 H | 250 | 46.3 | 60.2 | 26.6 | 76.4 | 12 | 2,650 |
| | 4 | 1100° C. × 20 H | 1050° C. × 12 H | 720° C. × 12 H | 250 | 47.2 | 62.1 | 27.8 | 75.4 | 5 | 2,726 |
| | 5 | 1100° C. × 20 H | 1050° C. × 12 H | 720° C. × 12 H | 250 | 47.5 | 59.7 | 23.3 | 75.5 | 11 | 2,640 |
| | 6 | 1100° C. × 20 H | 1050° C. × 12 H | 720° C. × 12 H | 250 | 45.2 | 56.7 | 26.5 | 72.5 | 8 | 2,460 |
| | 7 | 1100° C. × 20 H | 1050° C. × 12 H | 720° C. × 12 H | 250 | 44.4 | 57.2 | 28.3 | 76.5 | 12 | 2,350 |
| Comparison material | 8 | 1100° C. × 20 H | 1050° C. × 12 H | 720° C. × 12 H | 250 | *37.5 | *48.3 | 25.4 | 72.4 | *44 | *1,674 |
| | 9 | 1100° C. × 20 H | 1050° C. × 12 H | 720° C. × 12 H | 250 | *32.5 | *45.7 | 22.4 | 68.2 | *38 | *1,532 |
| | 10 | 1100° C. × 20 H | 1050° C. × 12 H | 720° C. × 12 H | 250 | 55.6 | 64.6 | *17.6 | *62.4 | *40 | *1,749 |
| | 11 | 1100° C. × 20 H | 1050° C. × 12 H | 720° C. × 12 H | 250 | 53.5 | 63.5 | *18.5 | *61.5 | *55 | 2,050 |
| | 12 | 1100° C. × 20 H | 1050° C. × 12 H | 720° C. × 12 H | 250 | *36.5 | 50.4 | 25.5 | 72.3 | *47 | *945 |
| | 13 | 1100° C. × 20 H | 1050° C. × 12 H | 720° C. × 12 H | 250 | 46.8 | 57.6 | *16.5 | *60.3 | *53 | *1,492 |
| | 14 | 1100° C. × 20 H | 1050° C. × 12 H | 720° C. × 12 H | 250 | 47.4 | 58.6 | 23.5 | 71.2 | 15 | *921 |
| | 15 | 1100° C. × 20 H | 1050° C. × 12 H | 720° C. × 12 H | 250 | *35.2 | *48.5 | 20.5 | 64.5 | *55 | *745 |
| | 16 | 1100° C. × 20 H | 1050° C. × 12 H | 720° C. × 12 H | 250 | *32.5 | *45.2 | 25.6 | 74.2 | *33 | *1,546 |

*:It shows poor characteristic as compared with invention material.

TABLE 3

| Heat treatment | Test material | Heat treatment conditions: Normalizing temperature (° C.) × Holding time (H) | Quenching temperature (° C.) × Holding time (H) | Tempering temperature (° C.) × Holding time (H) | Cooling speed at quenching (° C./H) | Tensile test at room temperature: 0.2% proof stress (kgf/mm²) | Tensile strength (kgf/mm²) | Elongation (%) | Reduction of area (%) | Impact test 50% FATT (° C.) | Creep rapture test: Test temperature: 600° C. Rupture stress: 15 kgf/mm² Rupture time (H) |
|---|---|---|---|---|---|---|---|---|---|---|---|
| Heat treatment according to the invention | 3 | 1100° C. × 20 H | 1050° C. × 12 H | 720° C. × 12 H | 250 | 46.3 | 60.2 | 26.6 | 76.4 | 12 | 2,650 |
| | 4 | 1100° C. × 20 H | 1050° C. × 12 H | 720° C. × 12 H | 250 | 47.2 | 62.1 | 27.8 | 75.4 | 5 | 2,726 |
| Comparison heat treatment | 3 | 1100° C. × 20 H | 1100° C. × 12 H | 720° C. × 12 H | 250 | 57.1 | 68.5 | *17.2 | *61.5 | *56 | 2,450 |
| | 3 | 1100° C. × 20 H | 940° C. × 12 H | 720° C. × 12 H | 250 | *36.2 | *49.3 | 25.5 | 72.3 | *39 | *1,632 |
| | 3 | 1100° C. × 20 H | 1050° C. × 12 H | 780° C. × 12 H | 250 | *38.6 | *50.6 | 27.6 | 76.3 | 15 | 2,565 |
| | 3 | 1100° C. × 20 H | 1050° C. × 12 H | 660° C. × 12 H | 250 | 58.2 | 69.7 | *18.5 | *62.5 | *48 | 2,621 |
| | 3 | 1100° C. × 20 H | 1050° C. × 12 H | 720° C. × 12 H | 30 | *36.6 | *48.9 | 26.4 | 69.2 | *37 | *1,621 |
| | 4 | 1100° C. × 20 H | 1100° C. × 12 H | 720° C. × 12 H | 250 | 49.2 | 64.3 | *18.2 | *61.5 | *44 | 2,630 |
| | 4 | 1100° C. × 20 H | 940° C. × 12 H | 720° C. × 12 H | 250 | *34.6 | *46.1 | 20.3 | 67.1 | *43 | *1,823 |
| | 4 | 1100° C. × 20 H | 1050° C. × 12 H | 780° C. × 12 H | 250 | *37.7 | *51.3 | 25.3 | 74.3 | 10 | 2,362 |
| | 4 | 1100° C. × 20 H | 1050° C. × 12 H | 660° C. × 12 H | 250 | 57.6 | 68.5 | *17.2 | *58.3 | *47 | 2,432 |
| | 4 | 1100° C. × 20 H | 1050° C. × 12 H | 720° C. × 12 H | 30 | *36.3 | *47.9 | 23.4 | 69.3 | *39 | *1,721 |
| | 4 | 950° C. × 20 H | 940° C. × 12 H | 720° C. × 12 H | 30 | *32.3 | *44.3 | 27.3 | 72.4 | *42 | *1,424 |

*It shows poor characteristic as compared with invention material.

What is claimed is:

1. A cast steel material for pressure vessels which contains, on a weight percentage basis, 0.04 to 0.1% C, 0.1 to 0.4% Si, greater than 0% and up to 0.2% Mn, 0.1 to 0.8% Ni, 3 to 4.5% Cr, 0.2 to less than 0.5% Mo, 0.2 to 0.4% V, 0.5 to 2% W, 0.01 to 0.06% Nb and/or Ta, 0.001 to 0.01% B, 0.005 to 0.045% Ti, 0.006 to 0.015% Al, greater than 0.005% and less than 0.01% N, 1 to 0.008% O, 0 to 0.015% P as an impurity, and 0 to 0.007% S as an impurity, the balance being Fe and incidental impurities, provided that the aforesaid contents of Ti, Al, O and N satisfies the following relationship:

$$N-0.29\{Ti-1.5(O-0.89Al)\}\leqq 0.0060\%.$$

2. A method of making a pressure vessel which comprises the steps of casting a cast steel material for pressure vessels as claimed in claim 1 to form a cast steel article in the form of a pressure vessel; normalizing the cast steel article by holding it at a temperature of 1,000 to 1,150° C. for 10 to 30 hours and cooling it to 200° C. or below; quenching the cast steel article by holding it at a temperature of 970 to 1,070° C. for 5 to 30 hours, cooling it at a cooling rate of 1 to 50° C. per minute until the temperature of various parts of the material reaches 600° C., and further cooling it to 200° C. or below; and tempering the cast steel article by holding it at a temperature of 680 to 740° C. for 5 to 20 hours.

* * * * *